United States Patent [19]

Kinzie

[11] 4,427,975

[45] Jan. 24, 1984

[54] UNOPENED-DOOR INDICATOR

[76] Inventor: James E. Kinzie, 1742 Sorrel Ct., Carlsbad, Calif. 92008

[21] Appl. No.: 258,621

[22] Filed: Apr. 29, 1981

[51] Int. Cl.[3] ..... G08B 13/08

[52] U.S. Cl. ..... 340/547; 340/528; 340/691; 340/693

[58] Field of Search ..... 340/528, 545, 547, 691, 340/693

[56] References Cited

U.S. PATENT DOCUMENTS

| | | | |
|---|---|---|---|
| 3,544,987 | 12/1970 | McMann, Jr. et al. | 340/547 X |
| 3,978,478 | 8/1976 | Schmitz | 340/528 X |
| 4,114,147 | 9/1978 | Hile | 340/528 |
| 4,206,450 | 6/1980 | Harden et al. | 340/528 |
| 4,258,358 | 3/1981 | Lee et al. | 340/547 X |
| 4,319,228 | 3/1982 | Daniels | 340/547 X |

*Primary Examiner*—Glen R. Swann, III

*Attorney, Agent, or Firm*—Laurance E. Banghart

[57] ABSTRACT

An electric indicator that includes an indicating light mounted in a small case containing electronic circuitry, a numerical keyboard, and a battery, the case being attached to a door or door frame, to show the returning user of the indicator whether or not the door has been opened since the indicator was last enabled by the user, typically by entering a secret sequence of numbers into the keyboard. An auxiliary input jack, for electrical connection to other doors and windows, is provided so that the indicator can indicate whether any of several doors and windows has been opened. An auxiliary output jack is provided for a remote indicating light, usually inserted into the peephole existing in many front doors so that the indicator light may be seen from the outside before opening the door. The same output jack may be used for triggering separate audible alarm devices. The indicator is easily adapted for use with drawers, bins, or windows if so desired.

6 Claims, 6 Drawing Figures

NOTES:
MS is Machine State
CS is Counter State
PLUG means Plug is mechanically inserted in remote or alarm jack

UNOPENED-DOOR INDICATOR

BACKGROUND OF THE INVENTION

There has always been the desire to know whether a door, drawer, or window has been opened. A returning resident often questions whether an unwelcome intruder is lying in wait or has been inside the house or apartment. Similar questions are: has the safe or other private enclosure been opened? Has the landlord been in the apartment without asking? These questions relate not only to forced entry but to any entry including entry with the use of a valid key.

Crude mechanical indicating devices have long been used. For example, a feather placed on the top edge of the door as it is closed will, hopefully, fall to the floor when the door is opened and remain there until the resident returns giving an opened-door indication. Certainly, many other inconvenient and unreliable indicators come to mind.

The art shows many door-security devices. Many devices are used for activating alarm systems. Others are designed for detecting the presence of invalid keys. There seem to be no devices designed for the specific purposes of the invention here.

SUMMARY OF THE INVENTION

The major object of this invention is to provide an electric indicator that shows the returning user of the indicator whether or not a door, drawer, bin, or window has been opened since the indicator was last enabled with coded means by the user.

The indicator is housed in a small case, typically the size of a cigarette package. The indicating element could be electromagnetic in the visual, infrared, or radio spectrums; it could be sonic or ultrasonic; and it could be magnetic. Some of these indicating means would require that the user carry a detector. Considering cost and user appeal, the preferred indicating element of this invention is an electric light bulb, and more specifically a light-emitting diode.

Clearly there must be communication between the door and the door frame, so that a door opening may be detected. Many variations of a door open/closed switch may be envisioned. The preferred switch of this invention is a magnetically-actuated switch within the indicator case. The switch is opened by close proximity to a small magnet attached to the opposite member of the door, door frame, combination. Thus no electrical or mechanical connection is required between the indicator case and any outside element.

Electrical power for the indicator may be supplied from household power or from one or more batteries enclosed within the indicator case. The nusiance of connecting wires and the inability to function during power outages makes the use of battery power a preferred choice of this invention. However, the use of battery power makes low power consumption a vital criterion in determining the effectiveness of the invention. A flashing light is practically as visible as a steady light and uses power proportional to its duty cycle (on-time divided by on-time plus off-time). A light-emitting diode is more visible at low duty cycles than an incandescent electric light. A duty cycle of 0.01 with flashes several times per second is clearly visible.

The enabling of the indicator can only be accomplished by secret coded means. There are several options. The electromechanical key lock as used in automobile ignitions is a possibility. Magnetically, optically, or electrically coded cards, as used in various vending machines, is another possibility. The burden of carrying keys, whether similar to car keys or similar to credit cards, seems burdensome and an integral numerical keyboard seems most effective. The user has a secret and almost unique number sequence: say 1-9-7. To enable the indicator, the user pushes the numbered keys in that sequence.

Once the door has been opened, the indication of opened-door, must be preserved until the indicator is again enabled with coded means. This holding of state could be accomplished by an electromechanical latching relay, but is more effectively accomplished with electronic circuitry.

Another object of this invention is to have failure modes, particularly those related to tampering, battery life, and poor connections, result in giving opened-door indication rather than an unopened-door indication. In other words, the user would rather have a false alarm than have false confidence in a malfunctioning or intentionally disabled indicator. Accomplishing this object is achieved by (1) having a lighted, or flashing light, be the unopened-door indication and by (2) designing the electronics such that power interruptions, broken-then reconnected-wires, and momentary shorts will not produce an unopened-door indication.

Another object of this invention is to provide an indicator that will accomplish all of the objects of this invention, even though it is mounted on the inside of the door. In most circumstances, it is desirable to mount the indicator inside the house or apartment in order to avoid the rigors of outside weather, tampering, and curiosity. This presents logical problems not discussed as yet. The user would normally enable the indicator with coded means just before leaving. He or she would then open the door, exit, and close the door. The opening of the door, without proper provisions in the indicator, would trigger an opened-door indication. In addition, when the user returned home, his or her opening of the door would extinguish the indicator light before it could be viewed. Two irrevocable time delays are thus needed: one between the coded resetting of the indicator and the actual enabling of the indicator; the other between actual door opening and the opened-door indication. The invention utilizes one electronic time delay circuit to accomplish both objects. A time delay of approximately thirty seconds is desirable for both delays.

Another object of this invention is to provide the electronic drive for an auxiliary output jack that may be used to drive either a remote indicator or an external audible alarm. While it is desirable that the indicator case be inside the house, it may well be desirable that the indicating light be visible from the outside so that the door need not be opened, even slightly, to detect an alarm situation. This is provided by a plug with 2-wire electric cord connected to a light which is inserted into the peephole existing in many front doors.

When the plug is inserted into the jack of the indicator box, the light mounted in the indicator case is disabled to save battery power. When such a remote indicator is used, there is no real need for the delay between door opening and opened-door indication so that the second delay described above is not used in the drive circuitry for this jack. This also makes the jack useful for driving external audible alarms, as the second delay would be positively objectionable in that case.

Another object of this invention is to provide the electronic drive for an auxiliary input jack whereby other doors and windows may be connected and the indicator will give the unopened-door indication only when no one of the group has been opened.

Another object of this invention is to provide a unique low-battery indicator. Two batteries are employed. The operating battery is connected directly to the circuitry. The back-up battery is connected, through a light-emitting diode to the operating battery. So long as the operating battery voltage is closer to the back-up battery voltage than the threshold voltage of the light-emitting diode, only the operating battery supplies power to the circuitry. When the operating battery voltage drops by more than the light-emitting diode threshold voltage, the back-up battery starts supplying power and the bulb-emitting diode glows. The user is instructed to then put the back-up battery in the position of the operating battery, and to put a new battery in the position of the back-up battery. This provides an extremely effective low battery indicator at essentially no cost to either the user or the manufacturer.

BRIEF DESCRIPTION OF THE DRAWINGS

The invention will be better understood by reference to the following figures in which.

DETAILED DESCRIPTION

Figure 1:
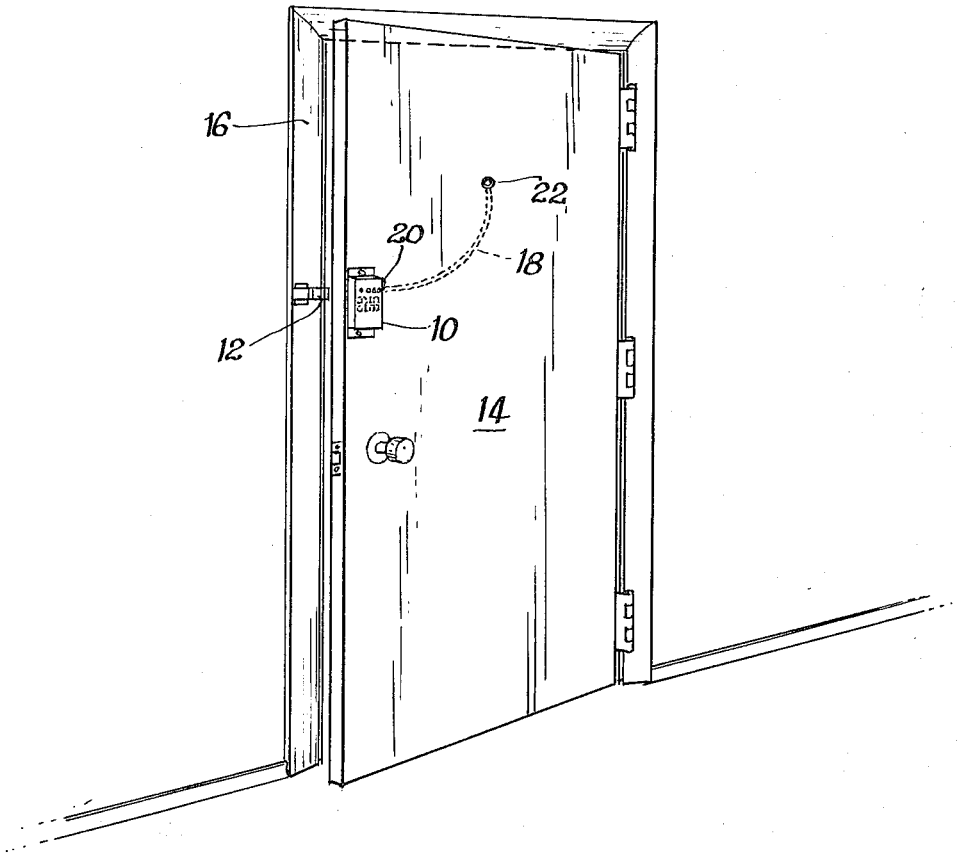
FIG. 1 is a perspective view of the unopened-door indicator case mounted on the inside of a representative door with a switch-actuating magnet mounted on the door frame and a remote indicating light in a representative peephole and connected to the auxiliary output jack on the indicator case.

Referring now to FIG. 1, the unopened-door indicator case 10 and the switch-actuating magnet 12 are shown mounted in place on a representative door 14 and door frame 16. A two-wire electric cord 18 is connected at one end to a plug 20 and at the other end to a remote indicating light 22. The plug is shown inserted into the auxiliary output jack, also at 20, and the indicating light 22 is shown inserted into a representative peephole, also at 22.

Figure 2:
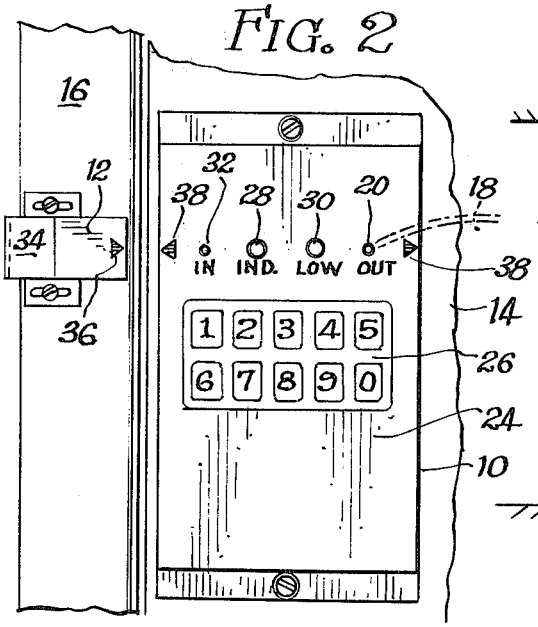
FIG. 2 is a front elevation view of the unopened-door indicator case mounted on a door with switch-actuating magnet mounted on a door frame.

FIG. 2 shows the outward face 24 of the indicator case. A ten key numerical keyboard 26 mounted in the case provides the user with the means of entering a secret sequence of numbers which resets and enables the indicator. An indicating light 28 is mounted in the case and the light flashes to indicate unopened-door and is unlighted to indicate the door has been opened. Another light 30 indicates a low operating battery voltage with a continuous glow. An auxiliary output jack 20 and an auxiliary input jack 32 are also mounted in the case.

The switch-actuating magnet 12 is shown attached with a representative clip 34 to the door frame 16. The magnet 12 and the case 10 have index marks, 36 and 38 respectively, to enable the installing user to properly align the magnet to the case and, more importantly, to its magnetically-actuated switch that is mounted inside the case 10 directly under the index mark 38. There are two index marks 38 and two switches thereunder because doors open from either the right or the left. With printed legends on the face of the case, the case cannot be turned upside down unless a double set of legends, on the face and numbers on the keys, were utilized.

Figure 3:
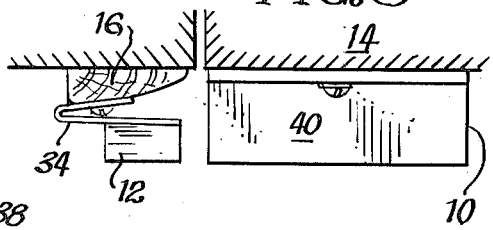
FIG. 3 is a top plan view of the unopened-door indicator case mounted on a door with switch-actuating magnet mounted on the door frame.

FIG. 3 shows the top face 40 of the indicator case 10 mounted on a representative door 14 and a top view of the switch-actuating magnet 12 mounted to the door frame 16 by means of a representative clip 34.

Figure 4:
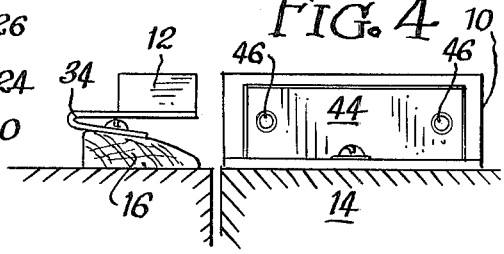
FIG. 4 is a bottom plan view of the unopened-door indicator case mounted on a door with switch-actuating magnet mounted on the door frame and showing means for installing batteries.

FIG. 4 shows the bottom face 42 of the indicator case 10 mounted on a representative door 14 and a bottom view of the switch-actuating magnet 12 mounted to the door frame 16 by means of a representative clip 34. The major portion of the bottom face 42 is a removeable tab 44 which may be removed with screw means 46 in order to change the internal batteries.

Figure 5:
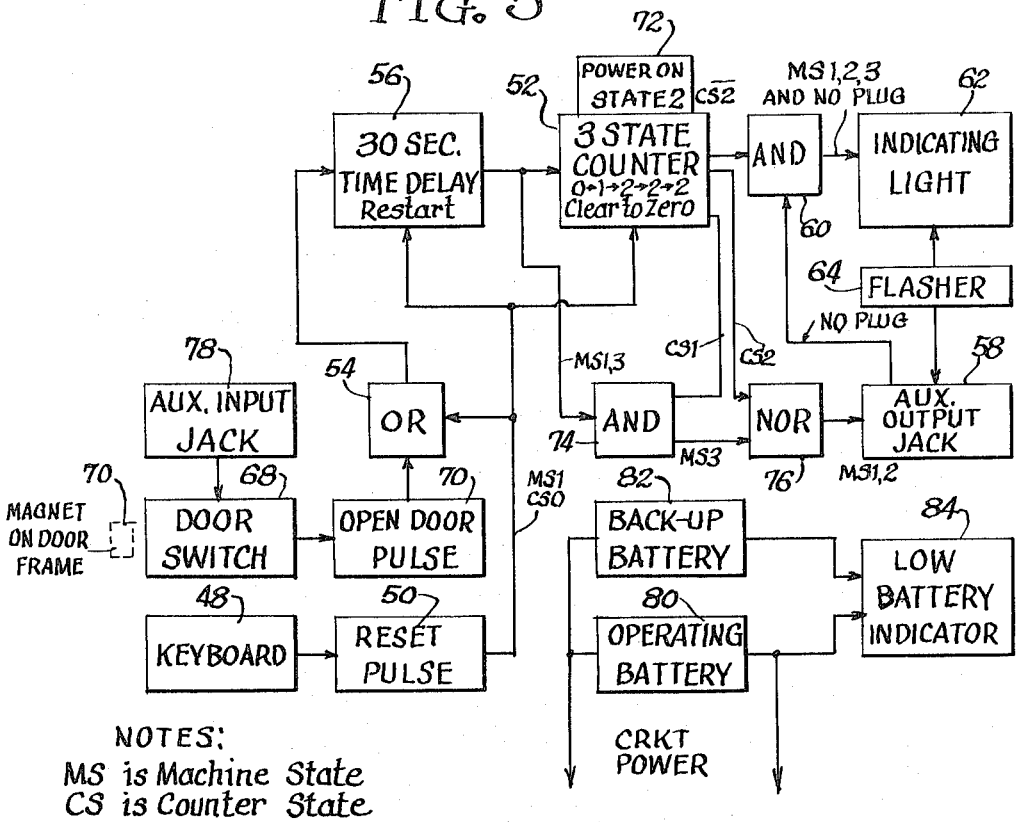
FIG. 5 is a block diagram of the electronic circuitry elements involved in a preferred embodiment of the unopened-door indicator.
Figure 6:
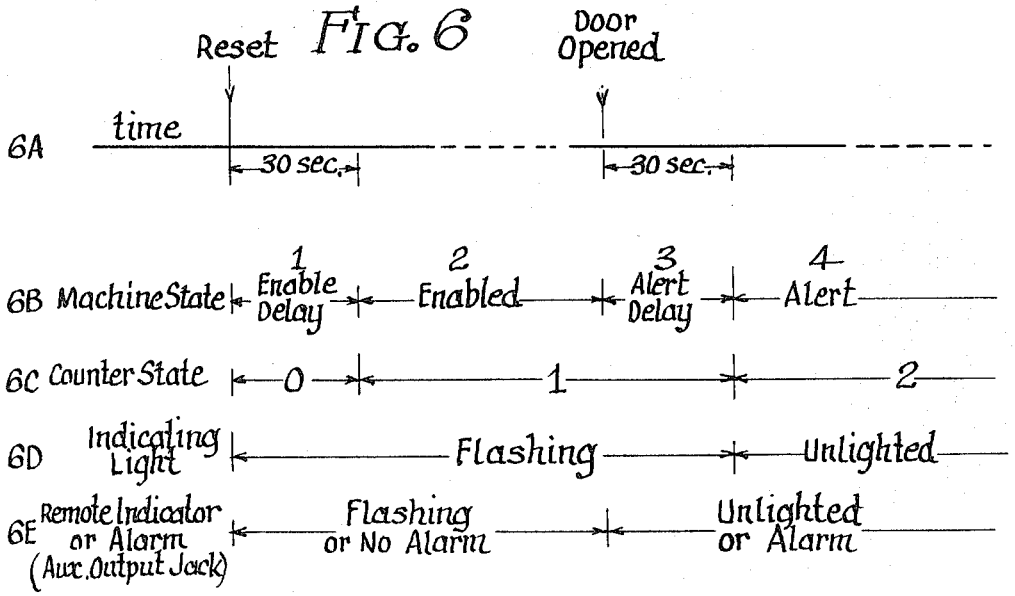
FIG. 6 is a timing diagram of the electronic circuitry elements involved in a preferred embodiment of the unopened-door indicator.

FIG. 5 and FIG. 6 will be used together to explain the operation of the electronic circuits of the preferred embodiment of the indicator. Numbers refer to FIG. 5 and FIG. 6 is referenced as appropriate. The keyboard electronics will be designed to put out a signal only when a code consisting of a sequence of 3 numbers is keyed in. This can be accomplished with 3 "d" flip-flops with appropriate interconnections. The last step in manufacture will be to put in three short jumper wires. The connections thus made will determine the code for the individual units. There are 720 different codes with 3 numbers. The keyboard electronics output goes to a reset pulse shaper 50, the output pulse going to: the 3-state counter 52, resetting it to counter state 0, FIG. 6C; through "or" gate 54 to start the 30 second time delay circuit 56; and to the restart input of the 30 second time delay circuit 56. With the pulse applied to both inputs of the 30 second time delay, a new 30 second delay is initiated even if a previously initiated time delay is in process. Thus a correctly coded input will reset, FIG. 6A, the indicator regardless of the state of the machine when the reset comes in.

Upon reset, the machine state is 1, "enable delay", FIG. 6B, and the counter state is 0, FIG. 6C. With no plug inserted in the auxiliary output jack 58, and the counter not in counter state 2, the "and" gate 60 provides an output to the indicating light 62 which is flashed by the flasher circuit 64, as shown in FIG. 6D.

During machine state 1, "enable delay", FIG. 6B, door openings will not be detected because when only one input is supplied to the 30 second time delay circuit 56 from the "or" gate 54, the 30 second time delay operation will not be initiated when a time delay is already in process. It is during machine state 1 that the user may exit the house and not cause an opened-door indication.

Machine state 1 ends and machine state 2, "enabled", FIG. 6B, starts automatically when the 30 second time delay circuit drives the 3-state counter to counter state 1. Machine state 1 remains (unless reset) until the door is opened. The indicating light is still flashing in this state, FIG. 6D.

When the door is opened, the door-actuated switch 68 closes because it is removed from the proximity of the magnet 70. This switch closure is shaped into a pulse 70 and goes through the "or" gate 54 starting a 30 sec time delay 56, there being no delay in process.

This second 30 second delay period is called machine state 3, "alert delay", FIG. 6B. The counter state is still 1, FIG. 6C and the indicating light is still flashing, FIG. 6D. It is during machine state 3 that the returning user can open the door slightly and see the flashing light, provided the door has not been opened since the indicator was last reset.

Machine state 3 ends and machine state 4, "alert", FIG. 6B, starts automatically when the 30 second time delay circuit drives the 3-state counter to counter state 2, FIG. 6C. The indicating light is now unlighted, FIG. 6D, because the "and" gate 60 receives no input from the 3-state counter and thus does not provide drive for the indicating light 62.

The counter latches at counter state 2 and further inputs to the counter from the 30 second time delay circuit have no effect. Furthermore, the counter is biased so that counter state 2 is the normal state when power is interrupted 72, such as when replacing batteries. It is important, as discussed above, that counter state 0 only be achieved with coded input means.

When there is a plug inserted in the auxiliary output jack, the "and" gate 60 does not receive at least one input and the indicating light 62 remains unlighted. The signal to the auxiliary output jack is flashed by the flasher circuit 64 but is only present during machine states 1 and 2, FIG. 6B. The signal is derived with "and" gate 74 and "nor" gate 76.

An auxiliary input jack 78 is connected in parallel with the door-actuated switch 68. Other similar switches on other doors and windows may be connected, all in parallel, to give the unopened-door indication only when no one of the group has been opened.

The operating battery 80 is connected directly to the circuitry. The back-up battery 82 is connected through the low battery indicator 84, a light-emitting diode, to the operating battery 80, the operation being as described above.

What I claim is:

1. An unopened-door indicator that shows the returning user of the indicator whether or not the door has been opened since the indicator was last enabled, and which comprises:

a. code input means;

b. a door-actuated switch;

c. an auxiliary output jack;

d. an indicating light;

e. electronic circuitry means responsive to a signal from said code input means when it is properly operated by the user, thereupon driving said indicating light to an un-opened door indication, providing a no-alarm signal to said auxiliary output jack, and providing a first delay of between 10 and 50 seconds before attaining an enabled state, thereupon becoming responsive to a signal from said door-actuated switch at the first opening of the door, thereupon becoming unresponsive to signals from said door-actuated switch, providing an alarm signal to said auxiliary output jack, and after a second delay of between 10 and 50 seconds, driving said indicating light to an opened-door indication; and f. power supply means for furnishing D.C. power to said code input means and said electronic circuitry means.

2. An unopened-door indicator according to claim 1 wherein the no-alarm and alarm signals provided by said electronic circuitry means to said auxiliary output jack are capable of driving a remote indicating light by means of an external two-wire electric cord.

3. An unopened-door indicator according to claim 2 wherein the power supply means is a battery and the indicating light is a light-emitting diode, flashing to indicate unopened-door and unlighted to indicate opened-door.

4. An unopened-door indicator according to claim 3 further comprising a back-up battery connected in parallel with said battery through a light-emitting diode which indicates when said battery needs to be replaced.

5. An unopened-door indicator according to claim 1 wherein the power supply means is a battery and the indicating light is a light-emitting diode, flashing to indicate unopened-door and unlighted to indicate opened-door.

6. An unopened-door indicator according to claim 5 further comprising a back-up battery connected in parallel with said battery through a light emitting diode which indicates when said battery needs to be replaced.

* * * * *